US009824571B2

(12) United States Patent
Sedayao et al.

(10) Patent No.: US 9,824,571 B2
(45) Date of Patent: Nov. 21, 2017

(54) ALERTING ON PROXIMITY OF ITEMS

(71) Applicant: Intel Corporation, Santa Clara, CA (US)

(72) Inventors: Jeffrey C. Sedayao, San Jose, CA (US); Yasaman A. Ghazizadeh, Los Gatos, CA (US); Tamela J. Bartolo, Pollock Pines, CA (US); Kenneth Paul Follosco, Santa Clara, CA (US); Sadhana Allen, Emerald Hills, CA (US)

(73) Assignee: Intel Corporation, Santa Clara, CA (US)

( * ) Notice: Subject to any disclaimer, the term of this patent is extended or adjusted under 35 U.S.C. 154(b) by 35 days.

(21) Appl. No.: 14/749,902

(22) Filed: Jun. 25, 2015

(65) Prior Publication Data

US 2016/0379464 A1 Dec. 29, 2016

(51) Int. Cl.

| | |
|---|---|
| ***G08B 21/00*** | (2006.01) |
| ***G08B 21/22*** | (2006.01) |
| ***G08B 21/02*** | (2006.01) |
| *G08B 19/00* | (2006.01) |

(52) U.S. Cl.

CPC ..... *G08B 21/22* (2013.01); *G08B 21/0275* (2013.01); *G08B 19/00* (2013.01)

(58) Field of Classification Search

CPC ..... G08B 21/18; G08B 1/08; G06K 9/6215
USPC ..... 340/686.6, 539.13, 539.15, 539.21, 340/239.23, 572.1

See application file for complete search history.

(56) References Cited

U.S. PATENT DOCUMENTS

| | | | | |
|---|---|---|---|---|
| 8,810,392 | B1 * | 8/2014 | Teller | G08B 21/24 235/385 |
| 2003/0137424 | A1 * | 7/2003 | Gehlot | G08B 13/1427 340/573.4 |
| 2008/0165058 | A1 * | 7/2008 | Ayachitula | G01S 7/4021 342/359 |
| 2008/0174425 | A1 * | 7/2008 | Torning | G08B 13/1427 340/540 |
| 2009/0089565 | A1 | 4/2009 | Buchanan et al. | |
| 2010/0188226 | A1 * | 7/2010 | Seder | G08B 21/24 340/572.1 |
| 2012/0013453 | A1 * | 1/2012 | Wyne | B60Q 1/525 340/425.5 |
| 2013/0120145 | A1 | 5/2013 | Lim | |
| 2014/0145829 | A1 | 5/2014 | Bassan-Eskenazi et al. | |
| 2014/0266698 | A1 * | 9/2014 | Hall | H04W 4/021 340/539.13 |

(Continued)

FOREIGN PATENT DOCUMENTS

KR 10-2011-0007458 A 1/2011

OTHER PUBLICATIONS

PCT International Search Report and Written Opinion, PCT Application No. PCT/US2016/028882, dated Jul. 29, 2016, 14 pages.

*Primary Examiner* — Phung Nguyen
(74) *Attorney, Agent, or Firm* — International IP Law Group, P.L.L.C.

(57) ABSTRACT

An apparatus alerts on a distance between items. The apparatus includes a radio for communicating with an internet of things (IoT) tag on an item. A locator module determines a distance between two or more items, and an alertor module alerts a user to a violation of a proximity rule.

28 Claims, 8 Drawing Sheets

(56) References Cited

U.S. PATENT DOCUMENTS

| | | | | |
|---|---|---|---|---|
| 2014/0347180 | A1 | 11/2014 | Rado | |
| 2015/0179033 | A1* | 6/2015 | Birk | G08B 13/1427 340/572.1 |

* cited by examiner

100

200

200

300

500

ALERTING ON PROXIMITY OF ITEMS

TECHNICAL FIELD

The present invention relates generally to devices for tracking devices. More specifically the present invention relates to devices that can be used to alert when proximity violations occur.

BACKGROUND

The distance of various items to other items can create situations that may cause problems. For example, some types and categories of chemicals need to be kept apart, like acids and bases, or oxidizers and lubricants, among others. Further, some items should be kept in close proximity, such as a flammable chemical and the particular kind of fire extinguishers that may extinguish a fire with that chemical, like a metal and a metal fire extinguisher. Some household items need to be kept apart, such bleach and ammonia. In other examples, items may need to stay in proximity to each other, such as a traveler and her luggage. Currently, the enforcement of proximity rules is performed by signs, placards, warning labels on items, or manual attention to conditions and locations.

BRIEF DESCRIPTION OF THE DRAWINGS

The same numbers are used throughout the disclosure and the figures to reference like components and features. Numbers in the 100 series refer to features originally found in FIG. 1; numbers in the 200 series refer to features originally found in FIG. 2; and so on.

DESCRIPTION OF THE EMBODIMENTS

Figure 1:
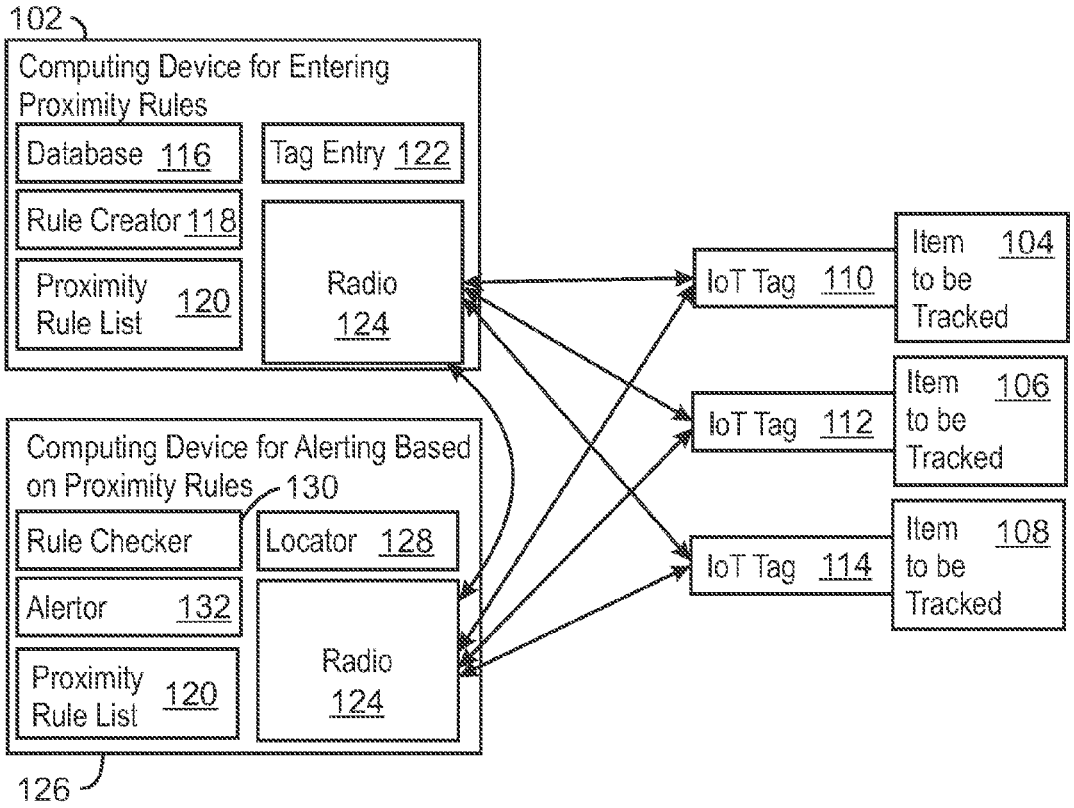
FIG. 1 is a block diagram of a system 100 for alerting on proximity of items in accordance with an embodiment.

The internet of things (IoT) is a concept in which a large number of computing devices are interconnected to each other and to the Internet to provide functionality and data acquisition at very low levels. For example, IoT networks may include commercial and home automation devices, such as light switches, thermostats, locks, cameras, alarms, motion sensors, and the like. Other devices may include sensors for health and fitness monitoring, such as pedometers and scales. These devices may be accessible through remote computers, smart phones, and other systems, for example, to control systems or access data.

The IoT technologies pushes intelligence to the edge instead of relying on a centralized intelligent system. This allows for querying of the asset itself resulting in the most up-to-date information regarding what you are searching for and allows for the asset to act in more autonomous nature without relying on manual intervention.

Apparatuses and methods described herein use internet of things (IoT) tags on items of interest to determine separations between items. The IoT tags are coupled with a rule set identifying items and the location significance for the item, e.g., whether they should be near another item, away from another item, or some combination of both. When the rules are not met, an alert or other actions can be generated. The rules can be processed by either a separate computing device or by the IoT tags themselves. The computing device that receives the alert or action can be a process control computer, a smartphone, a laptop, a wearable device, or one of the IoT tags.

As an example, rules for chemical storage and transportation are published, like the color code from JT Baker Chemical, or the Federal Hazardous Materials Regulations from the United States Department of Transportation (DOT), among others. Currently, the rules must be dealt with manually by personnel who understand the code. The present apparatuses and methods would provide automatic support to alert if items that should be separated are coming close together, such as bleach and ammonia containers, acids and bases, oxidizers and fuel, and the like.

As another example, the techniques provided herein may be used to inform personnel if they are proximate to a transient condition, such as a chemical release, a fire, a downed electrical line, a water line break, and the like. Further, the techniques can be used to make sure correct items are in proximity to areas. For example, a metal fire extinguisher (Class D) may be kept in a metal shop near activities that could cause a metal fire. If an incorrect fire extinguisher, e.g., class A, B, or C, is placed in this area, the system could alert.

The techniques may be useful in both the consumer space and in industrial settings—making sure that items that should be together are kept together, and making sure that items that should not be together are separated. In addition to using IoT devices like tags, it may be used in wearables, as it may incorporate a wearable device both for location determination and generating alerts.

Combinations of the techniques may be used to provide an overall environment approach. For example, the systems may alert when incompatible materials are too close to each other, an operator is too close to a transient condition, or when a fire extinguisher is placed too far from a location of use. Thus, a proximity rule system for describing generic policies that can be any combination of "keep apart" and "keep together" for any number of items.

The IoT tags may be constructed into a container by the manufacturer, removing the need to have each devices IoT tag entered into a rule system. In other examples, an IoT tag may be attached to a container and programmed, for example, through a bar code type device.

As used herein, alert means to inform a user of the system that a proximity rule has been violated. This may include an audio alert, such as a sound generated by a cellphone, tablet, IoT tag, and the like. The alert may also include a visual alert, such as a flashing light on a chemical cabinet, a light emitting diode (LED) on an IoT tag, and the like.

FIG. 1 is a block diagram of a system 100 for alerting on proximity of items in accordance with an embodiment. The system 100 may include a computing device 102 used for entering proximity rules, such as a tablet computer, a laptop computer, a scanner, a smartphone, an IoT tag, or an IoT gateway. As used herein, an IoT gateway is a system that may detect the presence of an IoT tag, read the identity of an item 104, 106, or 108 to be tracked from an associated IoT tag 110, 112, or 114, or alert on proximity rules for items 104, 106, or 108 to be tracked. The items 104, 106, or 108 to be tracked could include any number of different objects, such as chemical containers, consumer product containers, fire extinguishers, gas detectors, fire detectors, and the like.

In one example, a database of rules 116 may be present in, or accessed by, the computing device 102 used for entering the proximity rules. The database of rules 116 may contain a large number of potential interactions between materials, as well as alerting conditions. The database of rules 116 may be created from a material interactions database, such as the JT Baker color codes or DOT hazardous materials lists described herein. The database of rules 116 may be used by a rule creator 118 to generate a proximity rule list 120. The proximity rule list 120 may contain rules that are relevant to the materials entered or detected, with each rule governing how close or far apart each item 104, 106, or 108 should be from other items 104, 106, or 108.

As shown, each item 104, 106, and 108 may have an associated IoT tag 110, 112, and 114. The IoT tags 110, 112, or 114 may provide information about the item to the computing device 102 for creating the proximity rule list 120. The IoT tags 110, 112, or 114 for items 104, 106, or 108 may be attached at the time the item 104, 106, or 108 is received. In this example, the computing device 102 for entering the proximity rules may be used to program the IoT tag 104, 106, or 108 with the identity of the materials, as well as other information, such as the proximity rule list 120, for example, using a tag entry module 122.

The tag entry module 122 may be used to manually create a proximity rule list 120, for example, for items 104, 106, or 108 that are not in the database of rule 116. In some examples, the database of rules 116 may not be present, such as in consumer applications, and the tag entry module 122 may be used to enter the IoT tag 110, 112, or 114 and the rule for distance to other IoT tags 110, 112, or 114. For example, a piece of luggage, a purse, a key chain, and other personal items may have manually entered rules that alert if an attached IoT tag 110, 112, or 114 is further than an entered distance from another IoT tag 110, 112, or 114. In this application, for example, if one item 104 is a purse and other item 106 is a set of keys, the associated IoT tags 110 and 112 could alert if the purse and keys were farther than a preset distance from each other.

The computing device 102 for entering the rules may include a radio 124 for communicating with the IoT tags 110, 112, and 114. The radio 124 may use any number of communications protocols, such as WiFi (wireless local area network or WLAN), Bluetooth, Bluetooth low energy (BLE) or any other wireless protocol. Further, the radio 124 may be replaced with an optical communications system, such as an infrared (IR) system.

The computing device 102 may be used to enforce the rules as well as allowing entry of the rules. However, a separate computing device 126 may be used to enforce the rules. This may be, for example, an IoT gateway mounted on a chemical cabinet or delivery vehicle, a personal device, such as a cellphone or wearable, or a subunit in a larger system, such as an alert system in a process control computer or a home alarm system.

The computing device 126 for alerting based on the proximity rules may have a copy of the proximity rule list 120, either downloaded from the computing device 102 used for generating the rules, or generated locally, for example, by communicating with a remotely located database of rules. Further, the computing device 126 for alerting may itself be an IoT tag on an item to be tracked.

A locator module 128 may determine the distance of each of the IoT tags 110, 112, and 114 to each other and to the computing device 126 for alerting on rule violations. The locator module 128 may use any number of techniques for determining the distance between each IoT tag 110, 112, and 114. For example, the locator module may instruct each IoT tag 110, 112, and 114 to communicate with another IoT tags 110, 112, or 114 by sending a signal requesting a response from the other IoT tag 110, 112, or 114. The IoT tags 110, 112, and 114 may then calculate the distance to the other IoT tag 110, 112, and 114 by dividing the response time in half and converting it to distance. The computing device 126 for alerting may also determine the distance to each of the IoT tags 110, 112, and 114 using the same technique. The computing device 126 for alerting, and any of the IoT tags 110, 112, and 112 may include a global positioning system (GPS) satellite module to determine an absolute position, which may be used to determine the separation. Any number of other techniques, such as a shortest hop method in an ad-hoc network between the IoT tags, may also be used.

Once the distance between the individual IoT tags 110, 112, and 114 and between any of the IoT tags 110, 112, and 114 and the computing device 126 for alerting has been determined, the computing device 126 may confirm that there are no violations of the rules. This may be performed by a rule checker 130 module that uses the identity of the items, the distance between items, and the proximity rule list 120 to determine whether items are too close or too far apart. An alertor 132 module can then inform a user of the problem by triggering an alert.

Figures 2A, 2B:
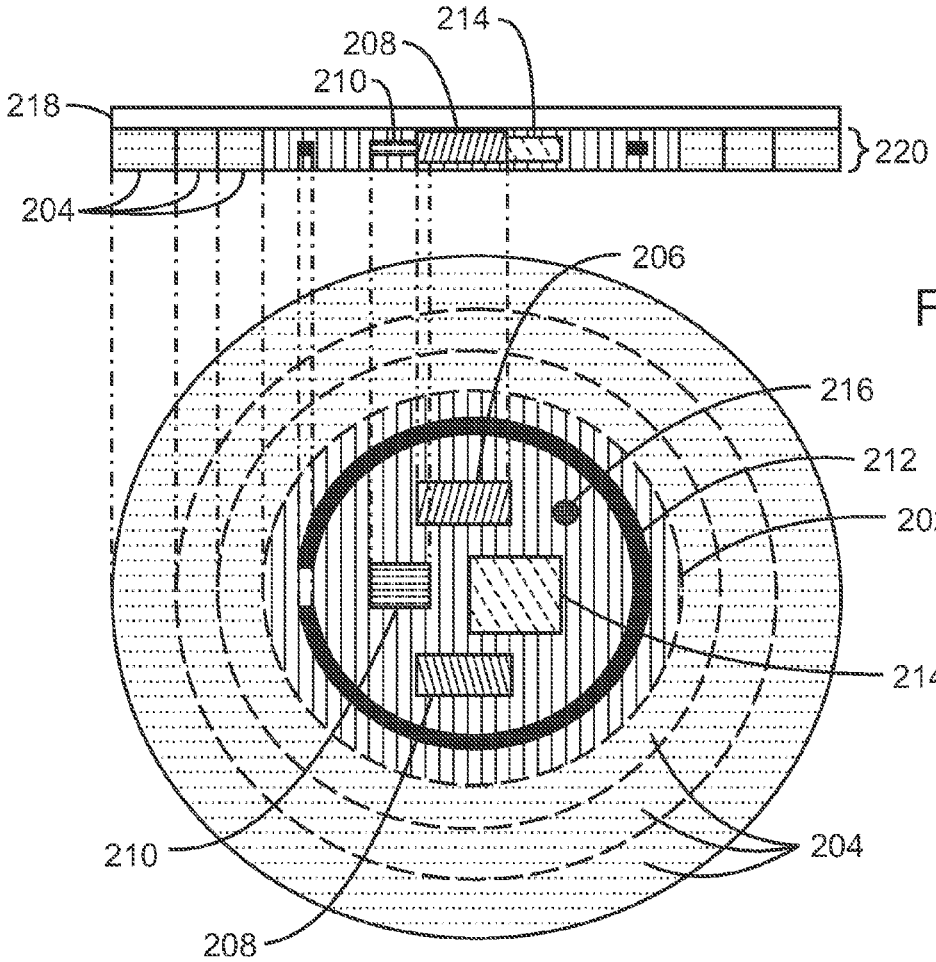
FIGS. 2A and 2B are a top view and a side cross sectional view of an internet of things (IoT) tag that may be used in an embodiment.

FIGS. 2A and 2B are a top view and a side cross sectional view of an internet of things (IoT) tag 200 that may be used in an embodiment. FIG. 2A is a top view of an IoT tag 200 that can be attached to an item to alert a user to a violation of a proximity rule. The IoT tag 200 has a central core 202 that includes the functional components and which may be surrounded by various mechanical devices 204 to assist in attachment. The mechanical devices 204 may include rings that assist in matching the diameter of the IoT tag 200 to a material container or item, for example, by being removed to make the diameter of the device smaller than that of the material container or item. However, these may not be used in other embodiments, for example, when the central core 202 is embedded in a material container.

The central core 202 may have a number of components to implement the functionality described herein. For example, the central core 202 may be equipped with one or more sensors 206 and 208, for example, to determine the location of the item and nearby IoT tags, or other conditions, such as a fire, gas release, or the like. A microcontroller 210, such as a system on a chip (SoC), may be used to obtain the data from the sensors 206 and 208 and communicate over a wireless connection, for example, using an antenna 212.

The microcontroller 210 may be powered by an embedded battery 214. The battery 214 may be selected to last for the average life span of a material container, e.g., about 6 months to about 1 year. In one embodiment, the wireless antenna 212 may be used to charge the battery 214 in addition to providing a communications link. The selection of a charging mode versus a network mode may be determined by the presence of an alternating current (AC) charging field. A beacon 216 can be used to alert a user to a rules violation from the IoT tag 200, for example, by lighting, flashing generating a sound, or any combination thereof. In some embodiments, the IoT tag 200 may be wired into a power supply to provide a continuous power source without the need to recharge.

In one embodiment, one or both of the sensors 206 and 208 may be responsive to pressure, for example, a pressure sensitive capacitor or a pressure sensitive resistor. A pressure sensor may be used to determine a load presented which will be directly proportional to the volume of content. This may allow the IoT tag 200 to alert when a container is empty.

The sensors 206 and 208 may include a motion detector, for example, an optical sensor that detects light changes, among others. The sensors 206 and 208 may include a proximity detection which may be responsive to changes in objects that are in proximity to the device. In one embodiment, the IoT tag 200 may detect other devices in proximity and synchronize activities, such as flashing the beacons on all involved IoT tags 200 when a rule violation is detected. The sensors 206 and 208 may be used to determine that a condition is present, such as a chemical release or fire. The condition may be considered a transient event that may be used with the proximity rules to alert an IoT tag on an operator to the presence of the event and warn if the operator gets too close to the IoT tag 200 that detected the transient event.

FIG. 2B is a side cross sectional view of the IoT tag 200. As shown in FIG. 2B, the central core 202 may be contained in an attachable device. For example, the attachable device may be disc shaped, square shaped, or in any other convenient configuration. As described with respect to FIG. 2A, the IoT tag 200 may be supplied with mechanical devices 204 to assist in attaching the IoT tag 200 to a material container or item. The IoT tag 200 may be attached to the material container or item through an affixing layer 218. The affixing layer 218 may be a hot melt adhesive, a cyanoacrylate adhesive, a polyurethane adhesive, or any number of other materials. The device may be hermetically sealed in an encapsulation 220 to prevent the infiltration of liquids. The encapsulation 220 and affixing layer 218 may be designed to be resistant to aggressive operating environments, for example, in a chemical plant, and like locations.

The central core 202 does not have to be permanently mounted to the material container or item. In one embodiment, the central core 202 may be contained in an attachable device which can be fitted to an appropriate mounting point on a material container or item. This allows the central core 202 to be reused after the materials are used. Further, the attachable central core 202 may be suitable for attachment to and removal from various types and form factors of items.

The IoT tag 200 is not limited to the parts and attachments described with respect to FIGS. 2A and 2B, but may include other systems. For example, the IoT tag 200 is not limited to radio communications. In one embodiment, an optical link can be provided for communication between an IoT tag 200, and an IoT gateway, such as a chemical cabinet. In this embodiment, information concerning the material, proximity rules, and the like, may be exchanged through a light emitting diode and phototransistor combination. This may occur when an item with the IoT tag 200 is placed in a cabinet.

The IoT tag 200 may have a separate transducer to generate sounds, for example, warning beeps, or tones. For example, the IoT tag 200 may be preprogrammed to give an audible warning, for example, if a container is placed too close to another container containing an incompatible materials, or if a personal item is too far from an owner.

Figure 3:
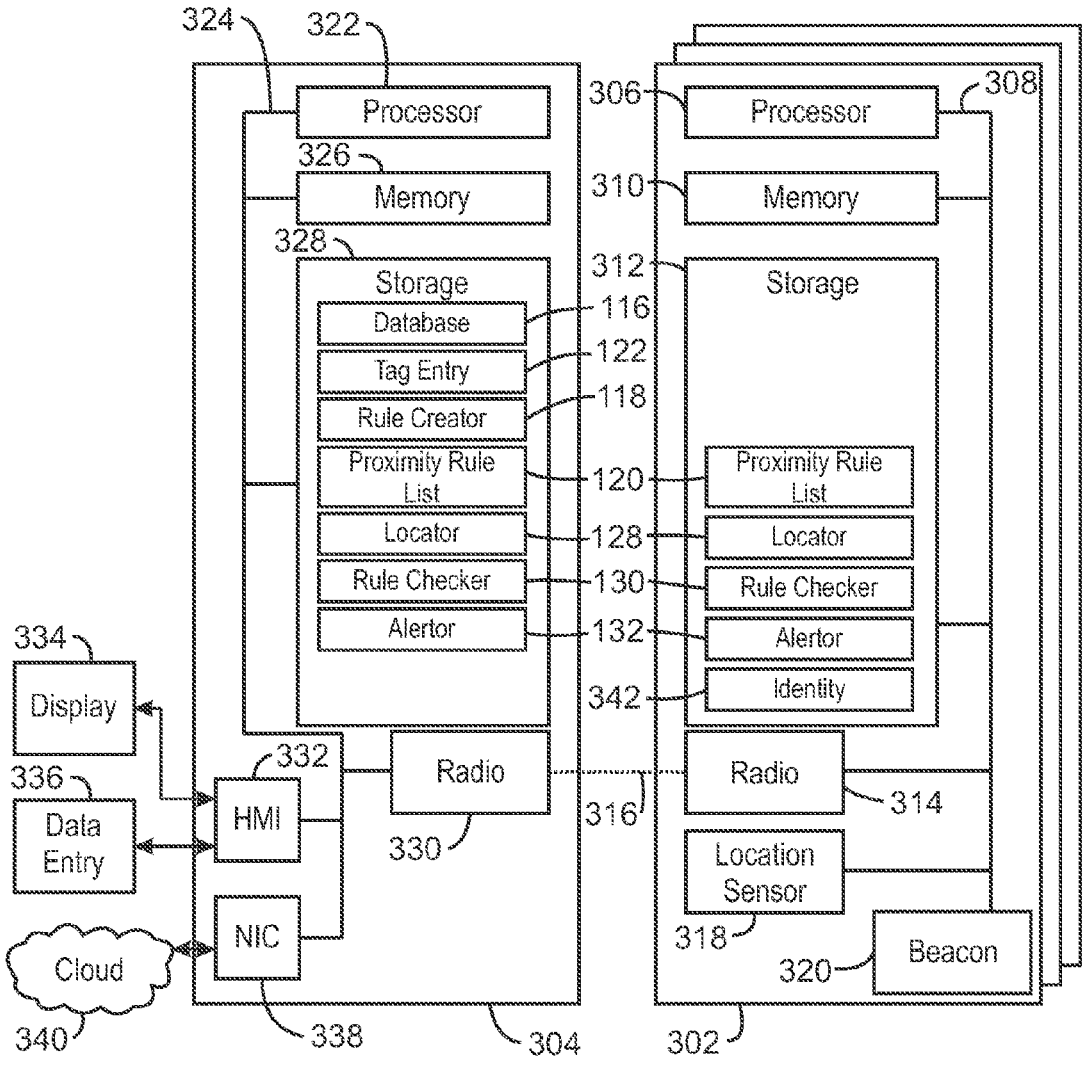
FIG. 3 is a block diagram of a system for alerting on the proximity of items in accordance with an embodiment.

FIG. 3 is a block diagram of a system 300 for alerting on the proximity of items in accordance with an embodiment. Like numbered items are as described with respect to FIG. 1. The system 300 may include one or more IoT tags 302, such as the IoT tags 110, 112, and 114 described with respect to FIG. 1, and a computing device, such as an IoT gateway 304. In this figure, the IoT gateway 304 may be used for both the entry and enforcement of proximity rules. However, this function may also be shared with, or located in, the IoT tags 302 themselves.

The IoT tags 302 may use a system on a chip (SoC) to simplify the design of the system 300. A SoC is a single integrated circuit that integrates all of the components needed for functionality. For example, the SoC may have a processor 306 coupled through a bus 308 to a memory 310. The memory 310 may be random access memory (RAM) used for storage of programs and data during operations. A storage device 312 may include read only memory (ROM), or other types of ROM such as electrically programmable ROM (EPROM), among others. The SoC may include a number of other functions, such as a radio 314, which may be a WLAN, a BLE, a WWAN, or any number of other protocols, as described herein. The radio 314 may communicate with the IoT gateway over a radio link 316.

The SoC may also include analog to digital convertors (ADCs) and digital to analog convertors (DACs) to drive a location sensor 318 and a beacon 320. Other units may be present, for example, if the beacon 320 includes a light emitter, a photodetector may be included to form an optical communications link.

The storage device 312 is a non-transitory machine readable medium that may include a number of functional blocks or modules to provide the functionality needed. These modules may be as described with respect to FIG. 1. Other functions that are not shown include various infrastructure functions, such as charging a battery, alerting a user to a low battery, and the like.

The IoT gateway 304 includes a processor 322 that communicates through a bus 324 with a memory 326. The IoT gateway may use an SoC, or may use any number of other types of processors, including, for example, a single core chip, a multicore processor, a processor cluster, and the like. The bus 324 may include any number of bus technologies, such as a peripheral component interconnect express (PCIe) bus, a PCI bus, a proprietary bus, or any number of others. The memory 326 is used for short term storage of operating programs and results, and may include dynamic RAM, static RAM, or any number of other memory technologies.

The processor 322 may communicate with a storage device 328 over the bus 324. The storage device 328 may be used for longer term storage of program modules, e.g., functioning as a non-transitory machine readable medium. The storage device 328 may include a hard drive, an optical drive, a flash drive, or any number of other technologies.

A radio 330 may be used to communicate with the IoT tags 302 over the radio link 316. The communications may be between the IoT gateway 304 and individual IoT tags 302, or as part of an ad-hoc network with a group of IoT tags 302.

A human-machine interface (HMI) 332 may be used to couple the IoT gateway 304 to a display 334 and a data entry unit 336. The display 334 and data entry unit 336 may be integrated into a single touch screen unit, for example, in a cellphone, tablet, or local controller. The HMI 332 may be used to alert to a proximity rule violation, for example, by flashing a light, sounding an audible alert, or both.

A network interface controller (NIC) 338 may be used to connect the IoT gateway 304 to a computing cloud 340. The cloud 348 may include a process control computer, a home alarm system, a local server network, the Internet, and the like. The database 116 may be located on a server in the cloud 340, and accessed by the IoT gateway 304 when an IoT tag 302 presents an identity 342 that is not in the proximity rule list 120.

The storage device 328 can include a number of code blocks to provide functionality to the IoT gateway 304 in the system 300. For example, the locator 128 can determine the distance between individual IoT tags 302, or the IoT gateway 304 and IoT tags 302 using the techniques described with respect to FIG. 1.

The system 300 is not limited to the devices or configurations shown. For example, the IoT tags 302 may themselves locate other IoT tags 302, as discussed with respect to FIGS. 4A and 4B. Further, the IoT gateway 304 may not be a separate unit, but may be part of an overall plant control system or home alarm system.

Figure 4B:
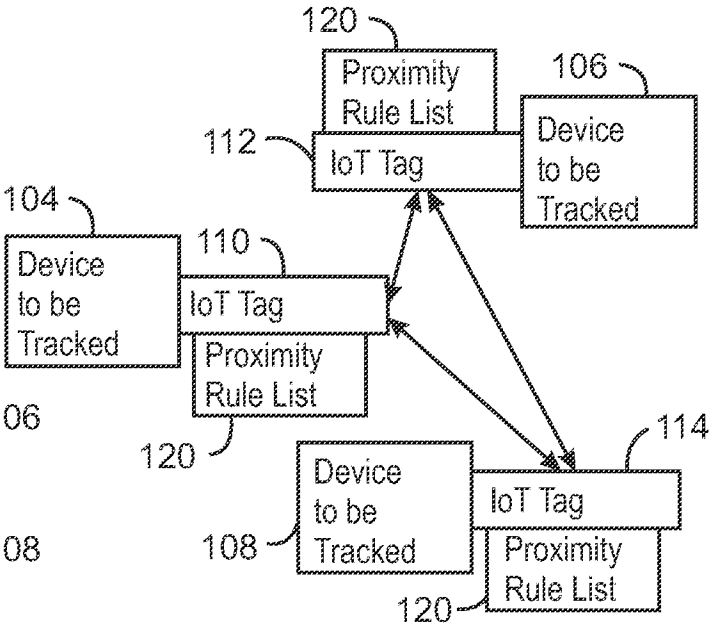
FIGS. 4A and 4B are block diagrams of another example of a system for alerting on the proximity of items in accordance with an embodiment.
Figure 4A:
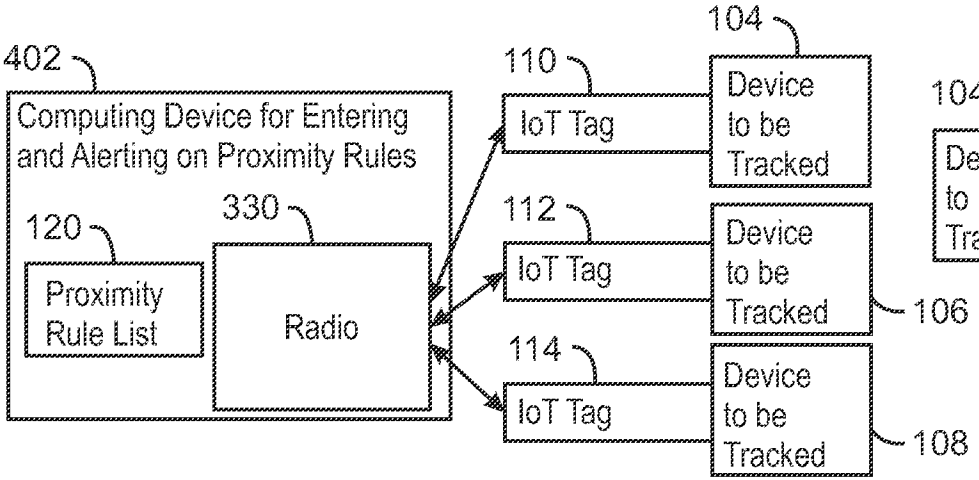

FIGS. 4A and 4B are block diagrams of another example of a system for alerting on the proximity of items in accordance with an embodiment. Like numbered items are as described with respect to FIG. 1. In this embodiment, as shown in FIG. 4A, a computing device 402 is used to program the IoT tags 110, 112, and 114, for example, by downloading the proximity rule list to the IoT tags. As shown in FIG. 4B, the IoT tags 110, 112, and 114 could then enforce the proximity rules themselves, for example, by forming an ad-hoc network between the IoT tags 110, 112, and 114. IoT tags may also have the capability for direct entry of the proximity rules. Combining devices together to lower the total number may provide for fewer devices, which may lower costs, but at the tradeoff of more critical points of failure. Further, combining the rule entering and alerting functions into the IoT tags 110, 112, 114 may make the IoT tags more complex and increases power requirements.

Figure 5:
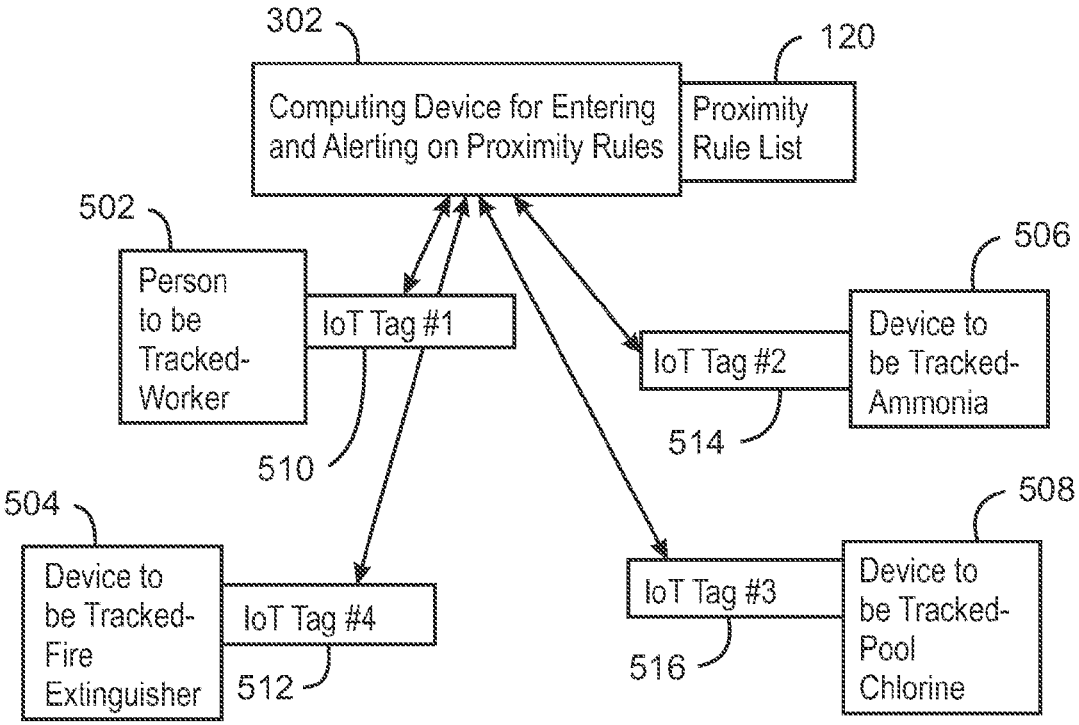
FIG. 5 is a block diagram of another example of a system for alerting on the proximity of items in accordance with an embodiment.

FIG. 5 is a block diagram of another example of a system 500 for alerting on the proximity of items in accordance with an embodiment. Like numbered items are as described with respect to FIGS. 1 and 3. In this example, a worker 502 with a fire extinguisher 504 may be moving an ammonia container 506 and a chlorine cylinder 508. The worker 502 may have a wearable IoT tag 510, for example, included in an ID badge. The fire extinguisher 504 also has an attached IoT tag 512, as do the ammonia container 506, e.g., IoT tag 514, and the chorine cylinder, e.g., IoT tag 516.

As the ammonia and chlorine can react in potentially dangerous ways, these chemicals should be kept some minimum distance apart, otherwise, an alert is sent to the worker. During the moving of the containers, the fire extinguisher 504 should be kept close to the chlorine, otherwise, an alert is sent to the worker 502. The ammonia container 506, chlorine cylinder 508, and fire extinguisher 504 should be close to the worker 502 so that no items are left behind before he is ready to leave the area. If the worker 502 gets too far from one of the items, for example, leaving the area before the job is finished, an alert is sent and a text message may be sent to the worker's supervisor. These rules can be expressed in a proximity rule list 120, for example, as shown in Table 1.

TABLE 1

Proximity Rule List

| RULE | TAG | TAG1 - Worker | TAG 2 - Ammonia | TAG 3 - Chlorine | TAG 4 - Extinguisher | ACTIONS |
|---|---|---|---|---|---|---|
| 1 | TAG1 - Worker | | Must be within 25 feet | Must be within 25 feet | Must be within 25 feet | Alert, text supervisor |
| 2 | TAG 3 - Chlorine | | Must be outside of 6 feet | | | Alert |
| 3 | TAG 4 - Extinguisher | | | Must be within 6 feet | | Alert |

If there are many items and IoT tags, as would be likely in a commercial environment, entering each tag into a rule base may be overly time consuming. Further, as new items enter the environment, each new IoT tag would have to be entered in order to add it to the rule set. Accordingly, the IoT tags may be configured to announce the attributes of the associated material. In this use case, IoT tag 516 on a chlorine cylinder 508 could announce that the associated material is chlorine, the IoT tag 514 on an ammonia container 506 could announce that the associated material is ammonia, and the IoT tag 512 on the fire extinguisher 504 could announce that the extinguishing material is suitable for a fire with chlorine. As a result, if new chlorine cylinders were brought near the ammonia, their associated IoT tags may announce that they have chlorine, which would trigger an alert. This would be done automatically without having to enter each IoT tags information into the proximity rule set. This may be implemented through a generic rule in the proximity rule set, for example, one that says that "All Chlorine associated tags must be at least 6 feet away from all Ammonia associated flags."

Figure 6:
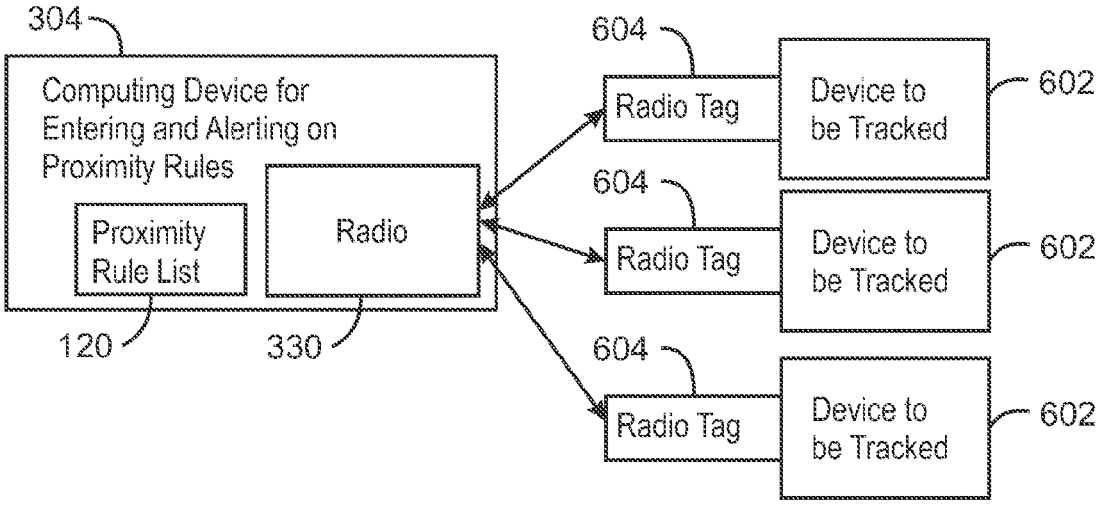
FIG. 6 is a block diagram of another example of a system for alerting on the proximity of items in accordance with an embodiment.

FIG. 6 is a block diagram of another example of a system 600 for alerting on the proximity of items in accordance with an embodiment. Like numbered items are as described with respect to FIGS. 1 and 3. This case may be a consumer use case that could be termed "do not forget." A person carrying a computing device, such as a smart phone, and does not want to forget items 602, places radio tags 604 on those items that need to be close together and not forgotten or left behind. The radio tags 604 may be entered into the smart phone, which will function as an entry device and alerting device. A rule may be entered that will alert if any device gets too far from another item 602 is put into the proximity rule base. Further, the computing device may track the proximity of items 602 to each other, and alert if any two items 602, such as keys and a purse, are separated by some distance.

Figure 7:
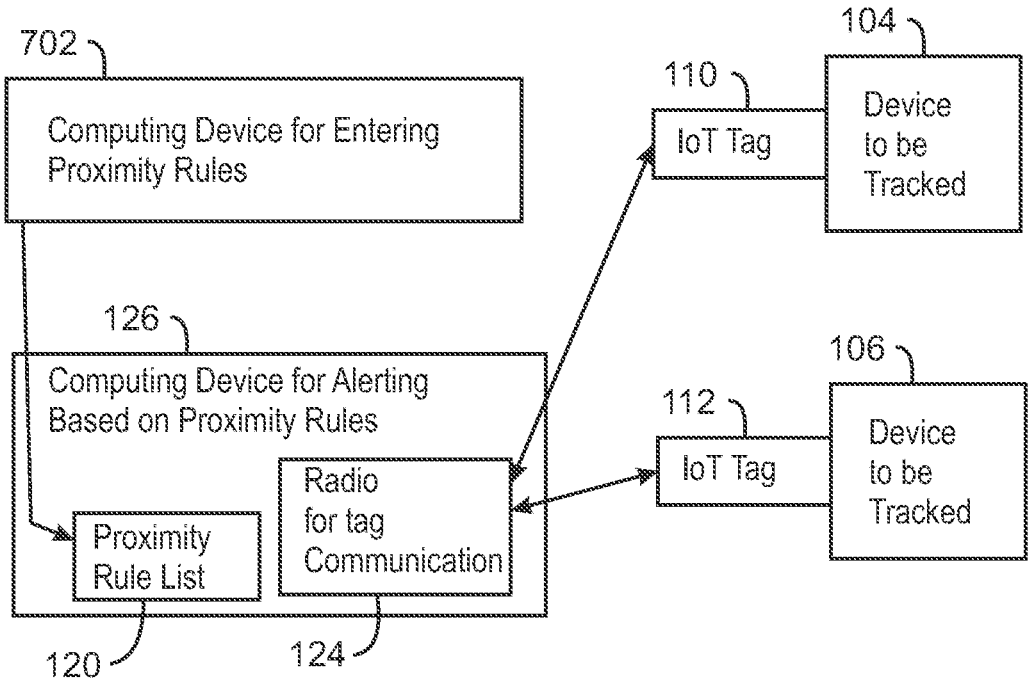
FIG. 7 is a block diagram of another example system for alerting on the proximity of items in accordance with an embodiment.

FIG. 7 is a block diagram of another example system 700 for alerting on the proximity of items in accordance with an embodiment. Like numbered items are as described with respect to FIG. 1. In this example, a computing device 702 may be used to enter proximity rules to a proximity rule list 120 in a computing device 126 that alerts based on the proximity rules. For example, proximity rules may be entered on consumer items that may have problematic interactions, such as ammonia and bleach. IoT tags 110 and 112 are attached to, or built into containers for the items. The minimum distance between the items 104 and 106 may be entered through the computing device 702 for entering the rules, such as a smartphone, a laptop, a personal computer, or a household security system. If the items 104 and 106 are determined to be too close together, the computing device 126 that alerts can generate an alert sound, send a text to a phone, or perform other functions.

As a consumer may not be aware of the utility in entering the items into the proximity rule list, a household IoT network, e.g., part of a household server network, may be used to detect the IoT tags 110 or 112, for example, if they are built into the containers. The household IoT network may then access a remote database to generate the proximity rules.

Figure 8:
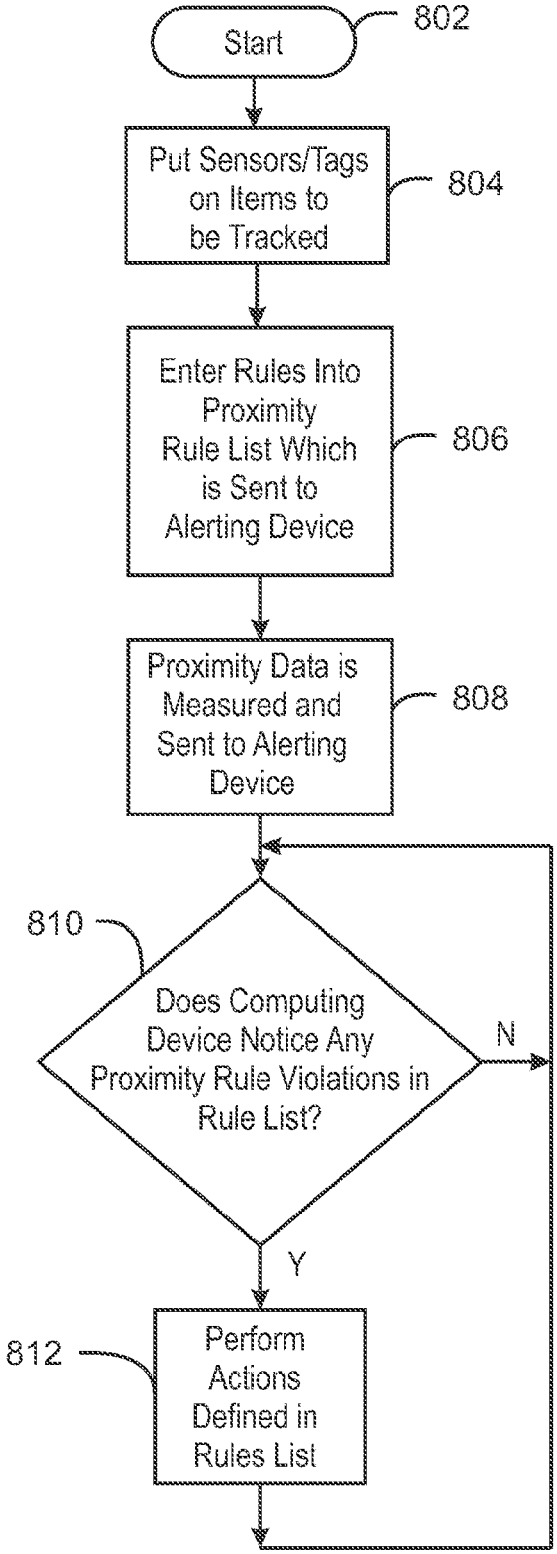
FIG. 8 is a block diagram of a method for alerting on the proximity of items in accordance with an embodiment.

FIG. 8 is a block diagram of a method 800 for alerting on the proximity of items in accordance with an embodiment. The method starts at block 802. At block 804, a user places IoT tags on items to be tracked. In some cases, this may not be necessary, for example, if the IoT tags were built into the containers.

At block 806, proximity rules are entered into a device which can use the rules to generate alert, send them to alerting devices, or both. At block 808, proximity data is measured and sent to an alerting device. The proximity data may be distances between items as directly determined by IoT tags associated with the items, or may be location information that can be used to generate the distances.

At block 810, the proximity data is compared to the rules to determine if any rule violations are detected. If not, process flow returns to block 808 to repeat the measurement of the proximity data. If a rule violation is detected, process flow proceeds to block 812, at which an action defined in a proximity rule list is performed. Once the action is completed, process flow returns to block 808 to continue to collect proximity data.

The method 800 is not limited to the blocks shown as blocks may be added or eliminated as needed. For example, the generation of the proximity rule list may be performed automatically upon detection of an IoT tag that reports an associated material.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine, e.g., a computer. For example, a machine-readable medium may include read only memory (ROM); random access memory (RAM); magnetic disk storage media; optical storage media; flash memory devices; or electrical, optical, acoustical or other form of propagated signals, e.g., carrier waves, infrared signals, digital signals, or the interfaces that transmit and/or receive signals, among others.

An embodiment is an implementation or example. Reference in the specification to "an embodiment," "one embodiment," "some embodiments," "various embodiments," or "other embodiments" means that a particular feature, structure, or characteristic described in connection with the embodiments is included in at least some embodiments, but not necessarily all embodiments, of the inventions. The various appearances of "an embodiment," "one embodiment," or "some embodiments" are not necessarily all referring to the same embodiments. Elements or aspects from an embodiment can be combined with elements or aspects of another embodiment.

Not all components, features, structures, characteristics, etc. described and illustrated herein need be included in a particular embodiment or embodiments. If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

It is to be noted that, although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

EXAMPLES

Example 1 includes an apparatus for alerting on a distance between items, including a radio for communicating with an internet of things (IoT) tag on an item. The apparatus includes a locator module to determine a distance between two or more items and an alertor module to alert a user to a violation of a proximity rule.

Example 2 incorporates the subject matter of Example 1. In this example, the apparatus includes a computing device for entering a proximity rule into a storage device.

Example 3 incorporates the subject matter of any combination of Examples 1-2. In this example, the apparatus includes an IoT gateway that determines that incompatible items are within a preselected distance to each other and alerts a user.

Example 4 incorporates the subject matter of any combination of Examples 1-3. In this example, the apparatus includes an IoT gateway that determines that items are not within a preselected distance to each other and alerts a user.

Example 5 incorporates the subject matter of any combination of Examples 1-4. In this example, the apparatus includes an IoT alert device configured to communicate with an IoT tag.

Example 6 incorporates the subject matter of any combination of Examples 1-5. In this example, the apparatus includes a battery, wherein the battery is built into the IoT tag.

Example 7 incorporates the subject matter of any combination of Examples 1-6. In this example, the apparatus includes an alerting device on an IoT tag.

Example 8 incorporates the subject matter of any combination of Examples 1-7. In this example, the apparatus includes a visible beacon, an auditory alarm, or both.

Example 9 incorporates the subject matter of any combination of Examples 1-8. In this example, the apparatus includes a radio communications device.

Example 10 incorporates the subject matter of any combination of Examples 1-9. In this example, the apparatus includes a radio communications device that includes a WiFi device, a Bluetooth device, a low energy Bluetooth device, a radio network device, or any combinations thereof.

Example 11 incorporates the subject matter of any combination of Examples 1-10. In this example, the apparatus includes an IoT gateway on a delivery vehicle configured to alert on detecting an attempt to load containers holding incompatible materials.

Example 12 incorporates the subject matter of any combination of Examples 1-11. In this example, the apparatus includes a chemical storage cabinet configured to alert on detecting an attempt to insert a container holding a material that is incompatible with a material in another container.

Example 13 incorporates the subject matter of any combination of Examples 1-12. In this example, the apparatus includes a fire extinguisher configured to alert on detecting that it is not proximate to the most likely point of use.

Example 14 provides a method for alerting a user to a violation of a rule selecting a proximity between items. The method includes determining a distance between two items and alerting a user when the distance violates a proximity rule, where the proximity rule indicates a minimum distance between the two items.

Example 15 incorporates the subject matter of Example 14. In this example, the method includes creating a proximity rule from a database of potential proximity rules, and sending the proximity rule to an internet of things (IoT) tag on an item.

Example 16 incorporates the subject matter of any combination of Examples 14-15. In this example, the method includes determining the distance between the two items by sending a radio signal from a first IoT tag on a first item to a second IoT tag on a second item, and calculating a distance based at least in part, on a time of flight (ToF) for a responding signal to be received by the first IoT tag.

Example 17 incorporates the subject matter of any combination of Examples 14-16. In this example, the method includes establishing an ad hoc network between a number of IoT tags.

Example 18 incorporates the subject matter of any combination of Examples 14-17. In this example, the method includes determining a location for each of the plurality of IoT by mapping a number of hops for each message in the ad hoc network to reach each of the plurality of IoT tags.

Example 19 incorporates the subject matter of any combination of Examples 14-18. In this example, the method includes determining a location for each IoT tag using a location sensor in the IoT tag, wherein the location sensor includes a global positioning satellite (GPS) receiver, a wireless wide area network (WWAN) receiver, or a wireless local area network receiver (WLAN), or any combinations thereof.

Example 20 incorporates the subject matter of any combination of Examples 14-19. In this example, the method includes alerting upon detecting that two items are outside of a proximity range.

Example 21 incorporates the subject matter of any combination of Examples 14-20. In this example, the method includes detecting a transient condition in an environment, and alerting upon determining that an IoT tag is approaching a minimum separation from a transient condition.

Example 22 incorporates the subject matter of any combination of Examples 14-21. In this example, the method includes detecting a gas release, a fire, or a water release, or any combination thereof.

Example 23 incorporates the subject matter of any combination of Examples 14-22. In this example, the method includes 23. The method of claim 21, including alerting in a control room upon determining that the IoT tag is closer to the transient condition than the minimum separation.

Example 24 includes a non-transitory, machine readable medium. The medium includes a rules database to determine a minimum separation between an item and another item, and instructions to direct a processor to detect a presence of the item and the other item and determine a distance between the item and the other item. The instructions direct the processor to instructions to direct a processor to compare the distance to the rules database, and activate an alert when a rule is violated.

Example 25 incorporates the subject matter of Example 24. In this example, the non-transitory, machine readable medium includes instructions to direct the processor to communicate with an IoT gateway.

Example 26 incorporates the subject matter of any combination of Examples 24-25. In this example, the non-transitory, machine readable medium includes instructions to direct the processor to establish an ad hoc network between a number of IoT tags.

Example 27 incorporates the subject matter of any combination of Examples 24-26. In this example, the non-transitory, machine readable medium includes instructions to direct the processor to send an identification for an IoT to a gateway.

Example 28 incorporates the subject matter of any combination of Examples 24-27. In this example, the non-transitory, machine readable medium includes instructions to direct the processor to sound an alert.

Example 29 includes an apparatus for alerting on a distance between items, comprising a means for determining a distance between two items, and a means for alerting a user when the distance violates a proximity rule, wherein the proximity rule indicates a minimum distance between the two items.

Example 30 incorporates the subject matter of Example 29. In this example, the apparatus includes a means for entering the proximity rule.

Example 31 incorporates the subject matter of any combination of Examples 29-30. In this example, the apparatus includes a means for determining that incompatible items are within a preselected distance of each other.

Example 32 incorporates the subject matter of any combination of Examples 29-31. In this example, the apparatus includes an IoT alert device configured to communicate with an IoT tag.

Example 33 incorporates the subject matter of any combination of Examples 29-32. In this example, the apparatus includes an alerting device on an IoT tag.

Example 34 incorporates the subject matter of any combination of Examples 29-33. In this example, the apparatus includes a visible beacon, an auditory alarm, or both.

Example 35 incorporates the subject matter of any combination of Examples 29-34. In this example, the apparatus includes a means for communicating between the two items.

Example 36 incorporates the subject matter of any combination of Examples 29-35. In this example, the apparatus includes a WiFi device, a Bluetooth device, a low energy Bluetooth device, a radio network device, or any combinations thereof.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. An apparatus for alerting on a distance between items, comprising:

a radio for communicating with an internet of things (IoT) tag on an item;

a locator module to determine a location of two or more items and to use the location to determine a distance between the two or more items;

a rule checker module to use an identity of the two or more items, the distance between the two or more items, and a proximity rule list to determine if a violation of a proximity rule has occurred; and an alertor module to alert a user in response to the violation of the proximity rule, wherein the violation of the proximity rule comprises incompatible materials that are too close to each other or safety equipment that is too far from a location of use.

2. The apparatus of claim 1, comprising a computing device for entering the proximity rule into a storage device.

3. The apparatus of claim 1, comprising an IoT gateway that determines that incompatible items are within a preselected distance of each other and alert the user.

4. The apparatus of claim 1, comprising an IoT gateway that determines that items are not within a preselected distance to each other and alerts the user.

5. The apparatus of claim 4, comprising an IoT alert device configured to communicate with an IoT tag.

6. The apparatus of claim 4, comprising a battery, wherein the battery is built into the IoT tag.

7. The apparatus of claim 4, comprising an alerting device on an IoT tag.

8. The apparatus of claim 4, comprising a visible beacon, an auditory alarm, or both.

9. The apparatus of claim 1, comprising a radio communications device.

10. The apparatus of claim 9, wherein the radio communications device comprises a WiFi device, a Bluetooth device, a low energy Bluetooth device, a radio network device, or any combinations thereof.

11. The apparatus of claim 1, comprising an IoT gateway on a delivery vehicle configured to alert on detecting an attempt to load containers holding incompatible materials.

12. The apparatus of claim 1, comprising a chemical storage cabinet configured to alert on detecting an attempt to insert a container holding a material that is incompatible with a material in another container.

13. The apparatus of claim 1, comprising a fire extinguisher configured to alert on detecting that it is not proximate to the most likely point of use.

14. A method for alerting a user to a violation of a proximity rule selecting a distance between items, comprising:

determining a location of two items;

using the location to determine a distance between the two items;

using an identity of the two items, the distance between the two items, and a proximity rule list to determine if the violation of the proximity rule has occurred; and alerting a user in response to the violation of the proximity rule, wherein the violation of the proximity rule comprises incompatible materials that are too close to each other or safety equipment that is too far from a location of use.

15. The method of claim 14, comprising:

creating the proximity rule from a database of potential proximity rules; and sending the proximity rule to an internet of things (IoT) tag on an item.

16. The method of claim 14, comprising determining the distance between the two items, by:

sending a radio signal from a first IoT tag on a first item to a second IoT tag on a second item; and calculating the distance based at least in part, on a time of flight (ToF) for a responding signal to be received by the first IoT tag.

17. The method of claim 16, comprising alerting upon detecting that the two items are outside of a proximity range.

18. The method of claim 14, comprising:

detecting a transient condition in an environment; and alerting upon determining that an IoT tag is approaching a minimum separation from the transient condition.

19. The method of claim 18, comprising detecting a gas release, a fire, or a water release, or any combination thereof.

20. The method of claim 18, comprising alerting in a control room upon determining that the IoT tag is closer to the transient condition than the minimum separation.

21. A non-transitory, machine readable medium, comprising:

a proximity rules database to determine a minimum or maximum separation between an item and another item; and instructions to direct a processor to:

detect a presence of the item and the other item;

determine a location of the item and the other item;

use the location to determine a distance between in the item and the other item;

use an identity of the item and the other item, the distance between the item and the other item, and the proximity rules database to determine if a violation of a proximity rule has occurred; and activate an alert in response to the violation of the proximity rule, wherein the violation of the proximity rule comprises incompatible materials that are too close to each other or safety equipment that is too far from a location use.

22. The non-transitory, machine readable medium of claim 21, comprising instructions to direct the processor to communicate with an IoT gateway.

23. The non-transitory, machine readable medium of claim 21, comprising instructions to direct the processor to establish an ad hoc network between a plurality of IoT tags.

24. The non-transitory, machine readable medium of claim 21, comprising instructions to direct the processor to send an identification for an IoT tag to a gateway.

25. The non-transitory, machine readable medium of claim 21, comprising instructions to direct the processor to activate the alert.

26. An apparatus comprising a network of Internet-of-Things (IoT) devices, comprising a plurality of IoT devices each configured to access a location of proximate IoT devices, and determine if the distance between the devices violates a proximity rule, wherein a violation of the proximity rule comprises incompatible materials that are too close to each other or safety equipment that is too far from a location of use.

27. The apparatus of claim 26, wherein the location of an IoT device is determined by a global positioning system (GPS) satellite module.

28. The apparatus of claim 26, wherein the proximity rule is violated if two IoT devices are too close together.

* * * * *